US005228806A

United States Patent [19]

De Medieros, Jr. et al.

[11] Patent Number: 5,228,806

[45] Date of Patent: Jul. 20, 1993

[54] GRAVITY PILE FOR PLATFORM FOUNDATION AND PROCESS FOR ITS INSTALLATION

[75] Inventors: Cipriano J. De Medieros, Jr.; Luiz H. Hassui, both of Rio de Janeiro, Brazil

[73] Assignee: Petroleo Brasileiro S.A.-Petrobras, Rio de Janeiro, Brazil

[21] Appl. No.: 701,170

[22] Filed: May 17, 1991

[30] Foreign Application Priority Data

May 25, 1990 [BR] Brazil ..... 9002463[U]
Feb. 25, 1991 [BR] Brazil ..... 9002463[U]

[51] Int. Cl.[5] ..... E02D 7/24; E02D 5/34

[52] U.S. Cl. ..... 405/231; 405/227; 405/228; 405/232; 405/249; 405/256

[58] Field of Search ..... 405/175.1, 224, 227, 405/228, 248, 249, 244, 251, 231, 250, 256

[56] References Cited

U.S. PATENT DOCUMENTS

| | | | |
|---|---|---|---|
| 415,037 | 11/1889 | Gray | 405/251 |
| 814,959 | 3/1906 | Healy | 405/228 X |
| 1,907,854 | 5/1933 | Moran | 405/249 X |
| 3,585,803 | 6/1971 | Bardgette | 405/251 |
| 4,058,175 | 11/1977 | Holland | 405/233 X |
| 4,154,552 | 5/1979 | Van Bilderbeek | 405/233 X |
| 4,257,722 | 3/1981 | Nakajima | 405/248 |
| 4,790,571 | 12/1988 | Montanari et al. | 405/251 X |
| 4,966,498 | 10/1990 | Blum | 405/233 |

FOREIGN PATENT DOCUMENTS

| | | | |
|---|---|---|---|
| 93977 | 8/1923 | Austria | 405/249 |
| 173419 | 10/1984 | Japan | 405/249 |
| 188526 | 9/1985 | Japan | 405/251 |

*Primary Examiner*—Dennis L. Taylor
*Assistant Examiner*—John Ricci
*Attorney, Agent, or Firm*—Beveridge, DeGrandi Weilacher & Young

[57] ABSTRACT

A gravity pile for platform foundations is described which comprises a series of pile sections made from two concentric tubes the annular space between which is filled with an elevated specific weight composition such as mortar or hematite. Individual pile sections can be joined together by means of tubular connecting rings welded to the ends of the sections and welded or screwed to each other. The uppermost section of the pile may be provided by a tubular support ring provided with a peripheral load bearing flange for simple direct contact support of the template designed to receive the tethers of the platform. A process is also described for installing the pile in which the pile penetrates the sea bed under its own weight and penetration is then complements by conventional undersea pile driving or preferably by jetting the interior of the pile using the drilling string of the rig. Further weight may be provide by adding cement to the interior of the pile using the same drilling line.

13 Claims, 7 Drawing Sheets

FIG. 5A
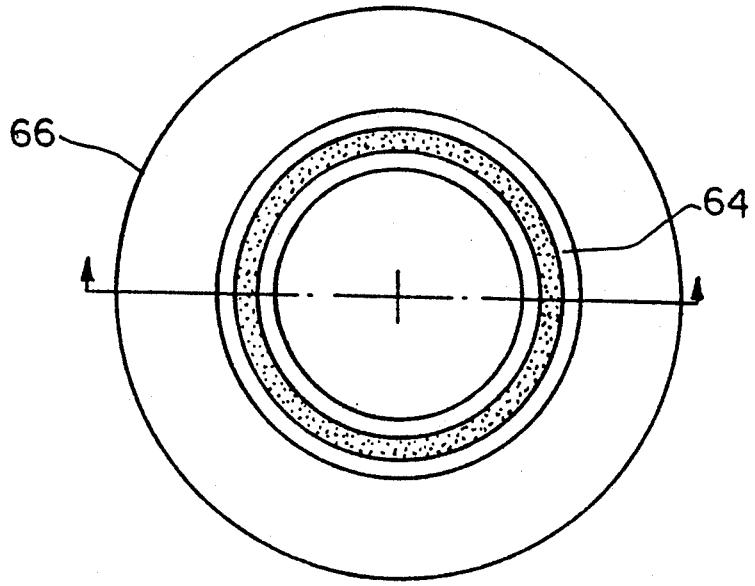
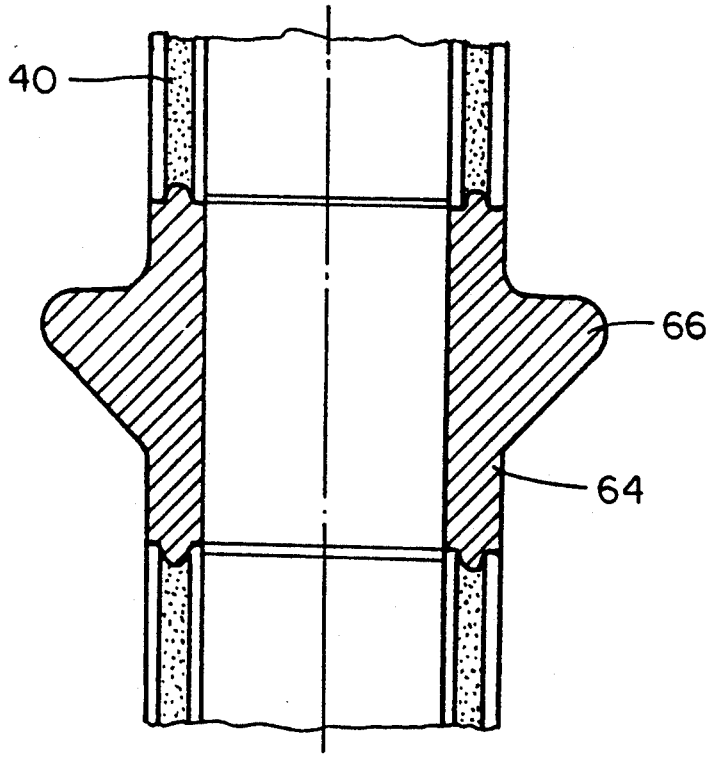
FIG. 5B

FIG. 6A
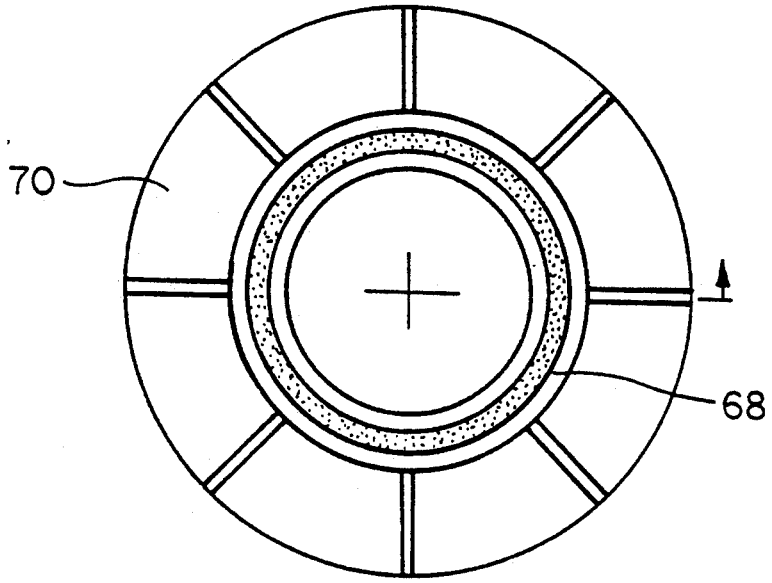
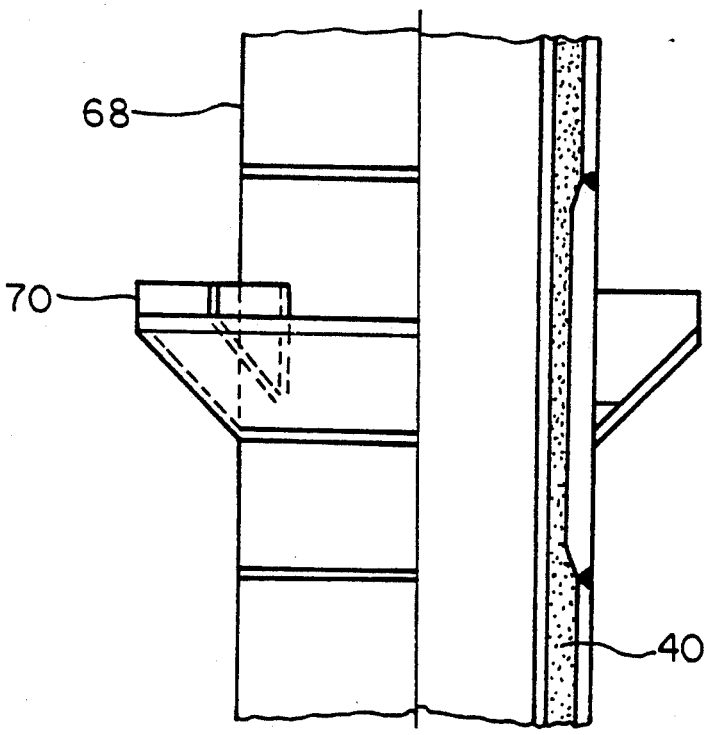
FIG. 6B

GRAVITY PILE FOR PLATFORM FOUNDATION AND PROCESS FOR ITS INSTALLATION

FIELD OF THE INVENTION

The present invention refers to a gravity pile for the foundations of a tensioned leg platform (TLP), as well as to a process for installing such pile.

STATE OF THE ART

Piles installed undersea for supporting the tethers of a Tensioned Leg Platform (TLP), comprise tubular piles driven or cemented into pre-drillings made in the marine floor. Such piles which are normally subject to elevated extraction forces, have a tensile load capacity defined by the lateral friction developed between the stem of the pile and the foundation floor.

When the profile of the the pile installation location comprises low load capacity soft clay, a large number of piles or large penetration depths become necessary which makes the foundation projects for anchoring structures by driven piles very expensive or even unviable.

In the case TLP type platforms, the piles are subject to high pull out forces with cyclic variations that depend on the ambiental conditions of the location. Apart from the natural difficulties in conducting precise geotechnical investigations at great depths, little is known about the behavior of piles in soft clay when submitted to cyclic traction forces. Phenomena such as degradation of the soil, and creep are still being investigated in an attempt to orient future investigations with a view to study TLP pile foundations.

DESCRIPTION OF THE INVENTION

With the object of solving the above mentioned problems, the present invention provides a cylindrical section gravity pile comprised of at least one pile section which is constituted by two concentric tubes with the annular space between them filled with an elevated specific weight composition, such as mortar or hematite.

Another object of the invention is a process for installing the above pile, greater penetration being obtained due to its weight. The increase in weight of the pile in accordance with the invention facilitates its installation in soft clay due to greater penetration under its own weight, penetration being complemented by conventional undersea pile driving or by jetting within the pile to facilitate its descent under its own weight, using the drilling string of a semi-submerged platform or test drillships.

In order to assemble the piles, cast or forged rings are used to join individual pile sections. Each pile section to be joined has one end of a tubular connecting ring welded to the ends of its concentric tubes, the other end of the tubular ring having a reduced wall thickness, such other end then being welded to the corresponding reduced wall thickness end of a similar connecting ring welded to the next pile section. Alternatively, the tubular rings may be screwed together at male and female threads formed on their ends so as to provide a suitable mechanical connection.

If the installation of the foundations is carried out by means of a rig and using the drilling string for the positioning and internal jetting of the piles, more weight to the piles may be added by filling their interior with high specific weight cement. Cementing may be effected using the same equipment used for the jetting but substituting cement for the salt water. Such an installation procedure permits simple mechanical connection between the piles and the template which receives the tendons of the platform. The mechanical connection between the piles and the template is effected by providing a cast or forged ring fixed to the top of the pile and having a curved profile flange which functions by direct contact with the template, or a ring fixed to the top of the pile which is provided with a straight sided surrounding flange made from welded plates.

DETAILED DESCRIPTION OF THE INVENTION

Such objects, characteristics and advantages of the present invention will be more apparent from the following detailed description made with reference to the accompanying drawings, in which:

FIGS. 5A and 5B are respectively plan and longitudinal cross sectional views of a cast or forged ring fixed to the top of the pile to effect mechanical coupling between the pile and the template:

FIGS. 6A and 6B are respectively plan and longitudinal cross sectional views of a ring fixed to the top of the pile and made from welded plates to effect mechanical coupling between the pile and the template;

Figure 1:
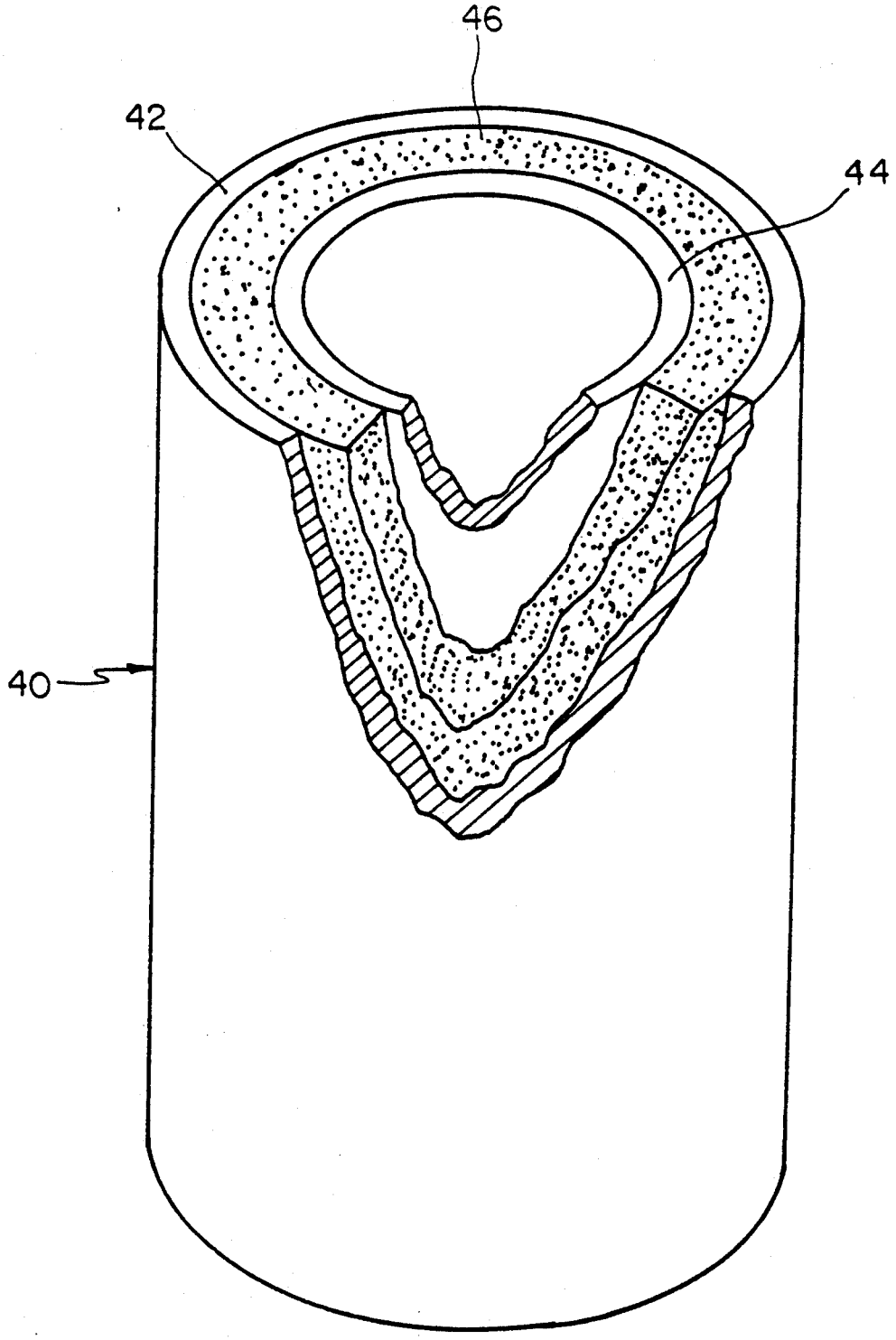
FIG. 1 is a perspective sectional view of a pile in accordance with the present invention.

As will be understood from FIG. 1, a cylindrical section gravity pile comprises a plurality of pile sections 40. Each pile section 40 comprises two concentric tubes 42 and 44, the annular space between which is filled with an elevated specific weight composition, preferably a high specific weight mortar or hematite. This composition has the purpose of adding weight to the pile sections 40, thus diminishing the traction force applied to the soil which, when it comprises soft clay, has a low cyclic residual traction resistance of difficult evaluation.

A pile of elevated weight can absorb all or almost all of the traction force transferred to the foundation of a TLP, thus diminishing the necessity of a larger number of piles and of a detailed knowledge of the foundation soil behavior for this particular type of structure. In order to foresee the behavior of the soil and to produce reliable geotechnical parameters for conventional pile designs, it would be necessary to conduct geotechnical investigations with expensive "in situ" tests to obtain representative soil samples for laboratory study and research.

Figure 3:
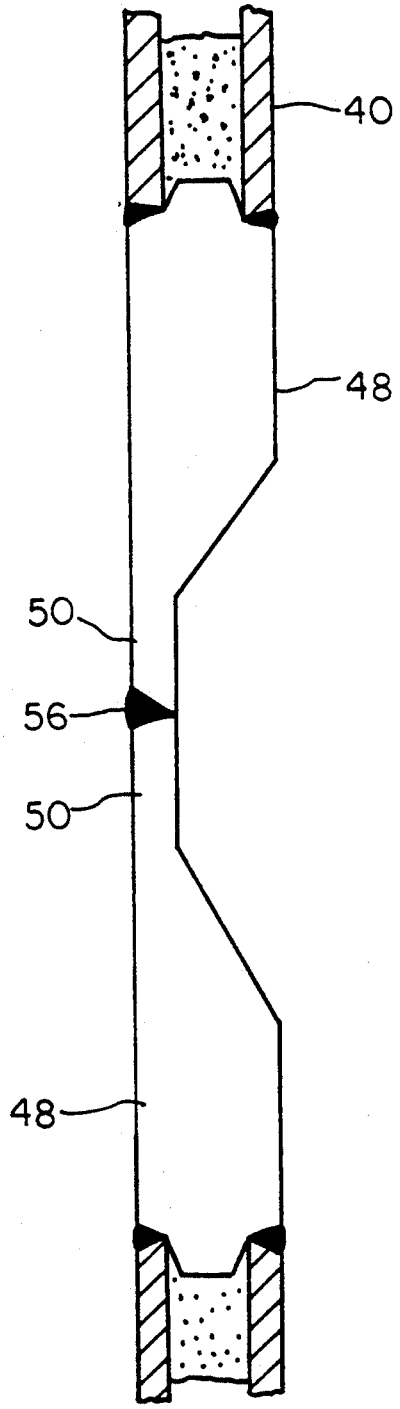
FIG. 3 is a cross section of the pile provided with tubular connecting rings with reduced wall thickness at one end.
Figure 4:
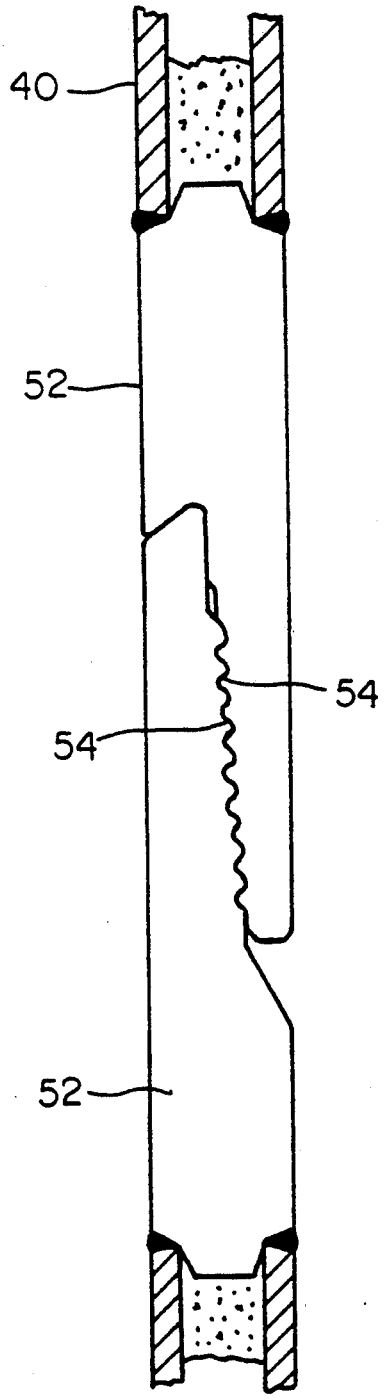
FIG. 4 is a cross section of the pile provided with tubular connecting rings with male-female type connecting threads at one end.
Figure 7:
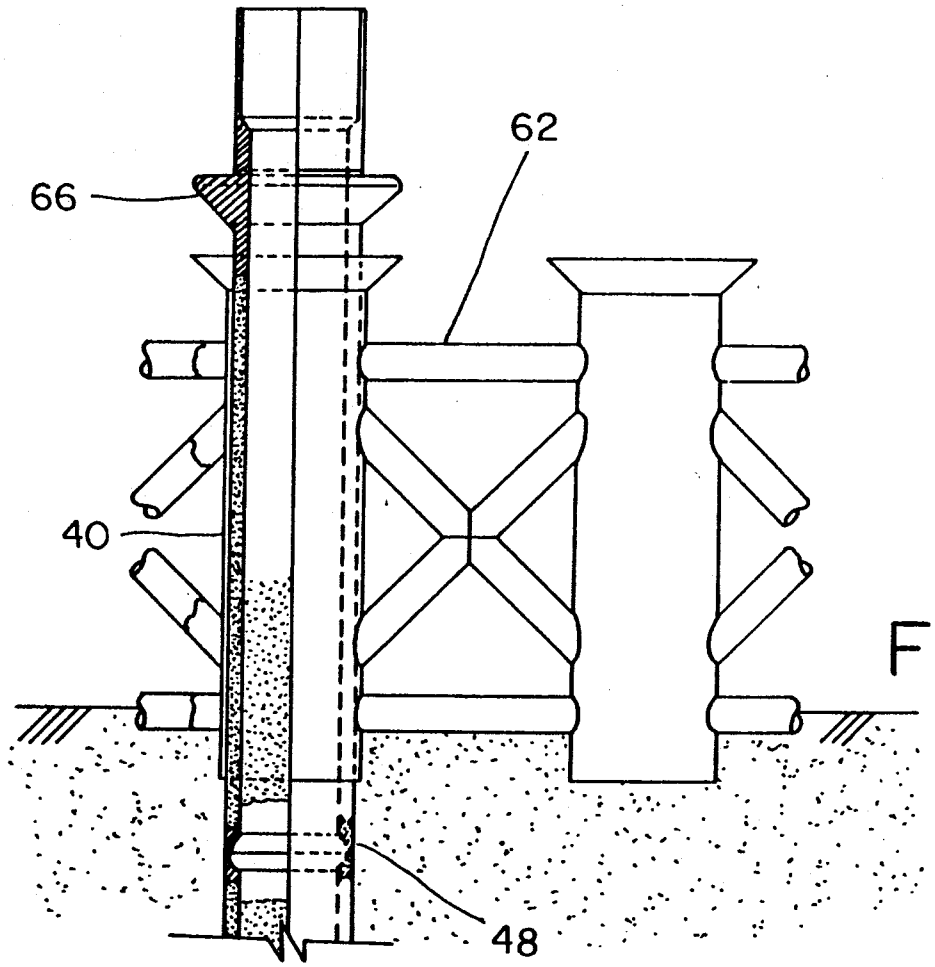
FIG. 7 is illustrative of the mechanical connection of the pile to the template using the cast or forged ring.
Figure 8:
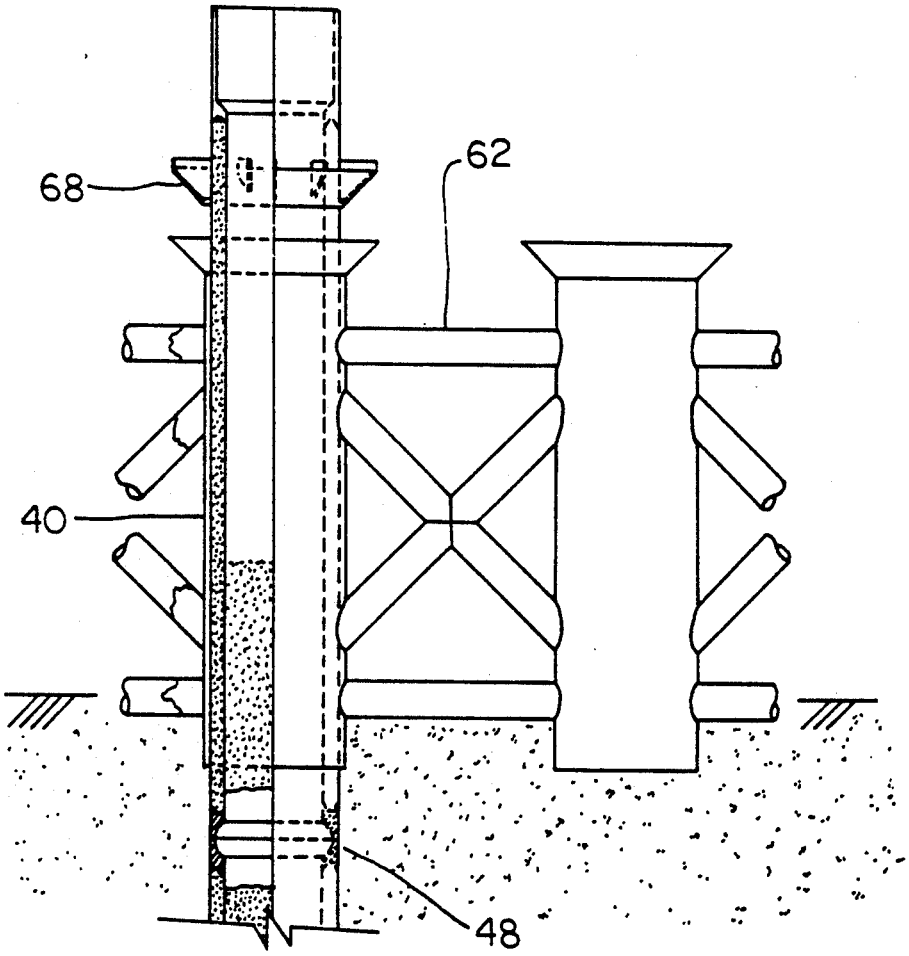
FIG. 8 is illustrative of the mechanical connection of the pile to the template using the ring made from welded plates.

In order to assemble the pile, cast or forged tubular rings 48 may be used, as shown in FIG. 3. Each ring 48 is welded at a first end to a corresponding end of its respective pile section 40 and has a second end 50 of reduced wall thickness. The ends 50 of two adjacent rings are then welded at 56 by means of a single circumferential weld to provide a suitable connection. Alternatively, as shown in FIG. 4, somewhat similar tubular rings 52 may be used, but in this case the ends of the rings that are to be connected together are formed with male and female type threads so that the pile sections can then be screwed together. Either of the arrangements shown in FIGS. 3 and 4 facilitates manufacture of the pile sections in work sites with access to the sea. The arrangement of FIG. 4 has the added advantage that the screw type connection avoids the necessity to effect a circumferential welding operation during assembly in the sea.

Figure 2:
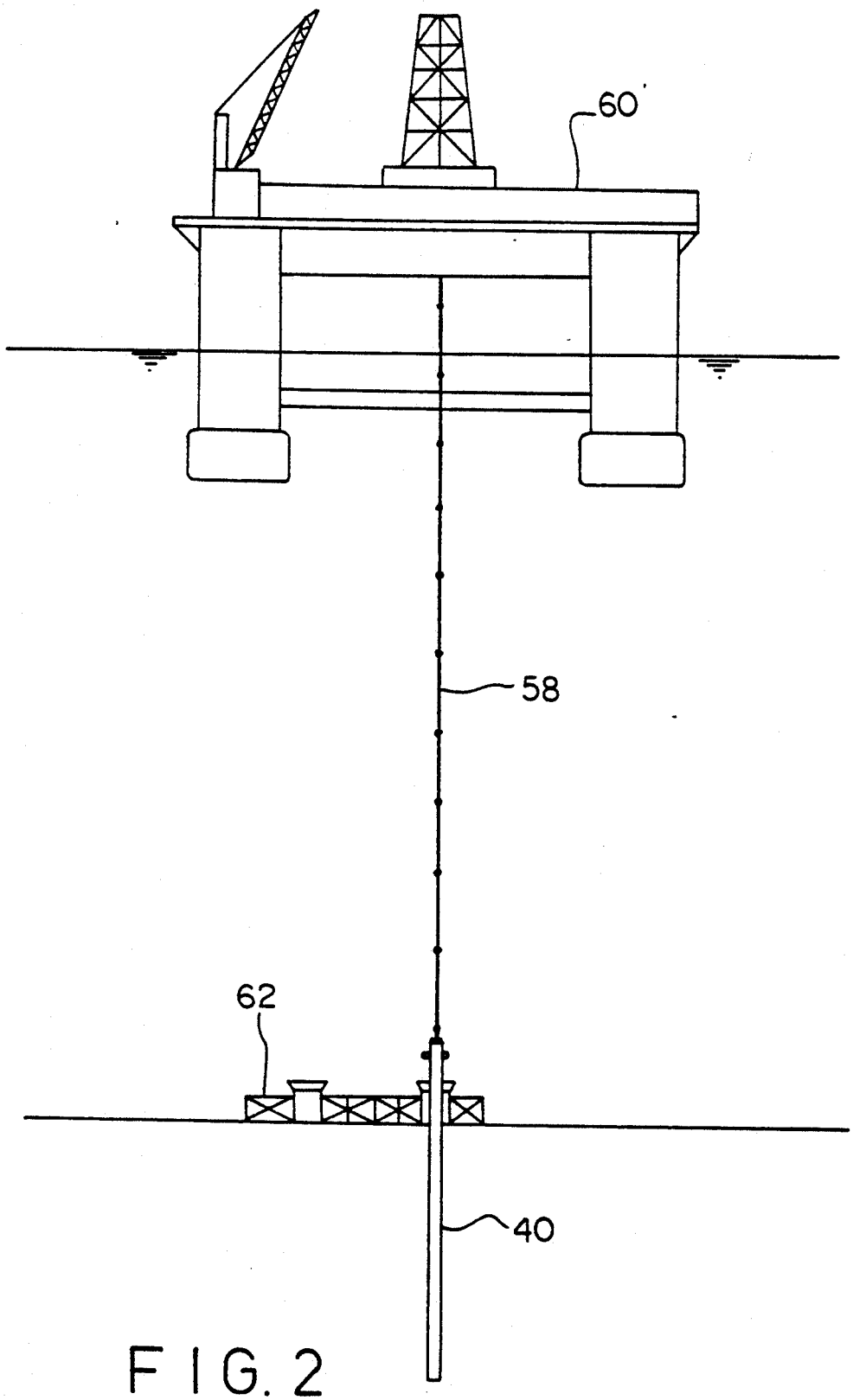
FIG. 2 is illustrative of the installation of the pile that has undergone penetration due to its own weight using the drilling string of a semi-submerged type platform.

A further object of the present invention is the installation of a pile made from pile sections 40 by achieving greater penetration due to its own weight. The increased weight of the pile, as proposed by the present invention by introducing an elevated specific weight composition in the annular space 46 defined between the concentric tubes 42 and 44, facilitates its installation in soft clay due to the greater penetration achieved under its own weight, it being possible to complement penetration by conventional undersea pile driving or by jetting the interior of the pile to assist penetration under its own weight, using the drilling string 58 of a semi-submersible type platform 60, as shown in FIG. 2, or a test drillship.

If the installation of the foundations is carried out with a test rig, using the drilling string for positioning and jetting the interior of the piles, additional weight can be added to the piles by filling their interior with elevated specific weight cement. Cementing may be effected using the same equipment utilized for the jetting except that salt water is substituted by cement mixture. Such installation procedure permits simple mechanical connection between the piles and the template 62 which receives the tethers of platform 60 since static pile driving is used, which maintains total control of the penetration of the tube.

The mechanical connection between the piles and the template 62 is effected by means of a cast or forged tubular ring 64 (FIGS. 5A and 5B) fixed to the top of one of the uppermost pile section 40 in the place of one of the pairs of connecting rings and provided peripherally with a curved profile load bearing flange 66 designed for direct contact with the template 62. Alternatively, one may use a ring 68 (FIG. 6A and 6B) having a peripheral straight sided load bearing flange 70 and made from welded plates. The use of such connection substitutes conventional grouting or hydrolock operations between the pile and the sleeve of the template, which are expensive when carried out in deep water locations.

The adoption of this invention in TLP type platform foundations, such as are necessary in Brazilian deep water oil fields, is extremely advantageous since it simplifies the installation of piles and increases the reliability of the foundations, minimizing the effect of uncertainties regarding the behavior of the marine soil for anchoring Tensioned Leg Platforms.

We claim:

1. Process for installing a gravity pile for a marine platform foundation, said gravity pile including two concentric tubes defining an annular space which is filled with a composition having an elevated specific weight, said method including the steps of driving the pile under its own weight into the marine soil and complementing aid driving by jetting the interior of said pile to facilitate penetration of the pile under its own weight into the marine soil, and adding further weight to said pile by filling the interior of said pile with a composition which has a high specific weight, said method also including the step of closing an end of said annular space by welding, to said two concentric tubes, a connecting ring which is positioned to close an end of said annular space.

2. Process according to claim 1, wherein the connecting ring has a portion which protrudes into said annular space.

3. Process according to claim 1 in which said pile is provided adjacent an upper end thereof with a peripheral flange, further comprising the step of positioning said flange for direct contact over a template designed to support tethers of said platform.

4. Process according to claim 1 including the step of complementing said driving by conventional subsea pile driving techniques.

5. Process according to claim 1 including the step of complementing said driving by jetting the interior of said pile.

6. A gravity pile for marine platform foundations, comprising a plurality of pile sections cooperating with each other in longitudinal relationship to form the said pile; each of said pile sections being formed by two concentric tubular elements defining an annular space therebetween, a high density composition filling said space, a plurality of tubular connecting rings which each have a first end attached to one end of a pile section and a second end attached to the respective second end of another said tubular connecting ring which, in turn, has its respective first end attached to another of said pile sections, thus connecting the said pile sections to each other to form the gravity pile, said connecting rings being welded to both of the respective concentric tubular elements.

7. A gravity pile according to claim 6, wherein said high density composition includes constituents selected from the group consisting of mortar and hematite.

8. A gravity pile according to claim 6, in which a said pile section has a top end, a tubular ring connected to said top end, said tubular ring having a peripheral load bearing flange.

9. A gravity pile according to claim 6, in which said flange has a curved profile.

10. A gravity pile for marine platform foundations, comprising a plurality of pile sections cooperating with each other in longitudinal relationship to form the said pile; each of said pile sections being formed by two concentric tubular elements defining an annular space therebetween, a high density composition filling said space, a plurality of tubular connecting rings which each have a first end attached to one end of a pile section and a second end attached to the respective second end of another said tubular connecting ring which, in turn, has its respective first end attached to another of said pile sections, thus connecting the said pile sections to each other to form the gravity pile, said connecting rings having portions which protrude into said annular spaces between the respective concentric tubular elements.

11. A gravity pile according to claim 10, wherein said high density composition includes constituents selected from the group consisting of mortar and hematite.

12. A gravity pile according to claim 10, in which a said pile section has a top end, a tubular ring connected to said top end, said tubular ring having a peripheral load bearing flange.

13. A gravity pile according to claim 12, in which said flange has a curved profile.

* * * * *